US005388597A

United States Patent [19]

Smith et al.

[11] Patent Number: 5,388,597

[45] Date of Patent: Feb. 14, 1995

[54] ARTIFICIAL FINGERNAIL REMOVER AND BRUSH CLEANER

[76] Inventors: Clifford W. Smith, 1410 Enka Way, Orlando, Fla. 32818; Judy K. Hall, 925 Larson Dr., Altamonte, Fla. 32714

[21] Appl. No.: 73,357

[22] Filed: Jun. 7, 1993

[51] Int. Cl.[6] ..... A45D 29/18

[52] U.S. Cl. ..... 132/73.5; 132/74.5

[58] Field of Search ..... 132/73, 73.5, 73.6, 132/74.5, 75

[56] References Cited

U.S. PATENT DOCUMENTS

| | | | |
|---|---|---|---|
| 4,180,884 | 1/1980 | Hess et al. | 15/21 R |
| 4,255,826 | 3/1981 | Boyd | 132/74.5 |
| 4,321,936 | 3/1982 | Chaconas | 132/73.5 |
| 4,474,195 | 10/1984 | Warner | 132/73 |
| 4,510,954 | 4/1985 | Miller | 132/73.5 |
| 4,607,752 | 8/1986 | Sherrow | 211/65 |
| 4,800,606 | 1/1989 | Kolesky | 132/73.6 |
| 5,007,441 | 4/1991 | Goldstein | 132/73.6 |
| 5,065,778 | 11/1991 | Terrell | 132/74.5 |
| 5,097,965 | 3/1992 | Fehr | 211/65 |
| 5,185,900 | 2/1993 | Warner et al. | 132/73.6 |

*Primary Examiner*—Gene Mancene
*Assistant Examiner*—Frank A. LaViola
*Attorney, Agent, or Firm*—Paul S. Rooy

[57] ABSTRACT

An artificial fingernail remover and brush cleaner comprising an upper housing attached to a lower housing, and a container removably attached to the lower housing. A door is sandwiched between the upper housing and the lower housing, and is free to reciprocate, covering and uncovering access to the inside of the container as it does so. A spring urges the door into the closed position, thereby preventing evaporation of the container contents. The door may be retained in the open position by rotating a door handle rigidly attached to the door. The door perimeter incorporates brush notches whereby a brush may be immobilized to soak in the solvent in the container without deforming its bristles.

8 Claims, 7 Drawing Sheets

ARTIFICIAL FINGERNAIL REMOVER AND BRUSH CLEANER

BACKGROUND OF THE INVENTION

1. Field of the Invention

The present invention relates to artificial finger nail removers, and in particular to an artificial fingernail remover and brush cleaner.

2. Background of the Invention

Artificial fingernails have become popular in the field of cosmetic enhancement. The artificial fingernails are typically either glued on (generally using brush-applied acrylic cement), or built up using an artificial fingernail form. After the process is complete, the brush used to apply the cement or to create the built-up nail, must be cleaned. Acetone is the most frequently used solvent for this purpose.

Artificial fingernails are generally removed by first protecting the wearer's fingers with a skin protector, and then soaking the wearer's fingertips in acetone. The acetone is a powerful solvent, and dissolves the cement used to hold the artificial fingernails in place.

There are a number of problems associated with the equipment currently used to clean the brushes and soak off artificial fingernails. To start out with, acetone is a powerful solvent, and tends to evaporate quickly. In its gaseous form, acetone may irritate the throat, lungs and eyes of exposed individuals. Over time, contact with acetone can pose a serious health hazard, especially to professionals such as manicurists and beauticians who are exposed to acetone on a daily basis. Acetone may also be used to remove fingernail polish, thus increasing the concentration of ambient acetone.

The most common currently available acetone containers are small jars in which fingers or brushes are soaked. While these jars are in use they remain uncovered, thereby allowing the acetone contained in them to evaporate freely.

Brushes are typically placed in acetone jars bristles down (so as to be immersed the in acetone). This method of brush cleaning not only allows acetone to evaporate into the ambient over extended periods of time, but also tends to deform the bristles due to the weight of the brush pushing down on them.

SUMMARY OF THE INVENTION

Accordingly, it is an object of this invention to provide an artificial fingernail remover and brush cleaner which reduces solvent evaporation to a minimum when used to remove artificial fingernails or fingernail polish. Design features permitting this object to be accomplished include a lower housing having a lower housing aperture attached to the solvent container, and a door capable of covering the lower housing aperture. Benefits associated with the accomplishment of this object include reduction of evaporated solvent in the ambient, along with the associated health benefits, and less solvent waste.

It is an another object of this invention to provide an artificial fingernail remover and brush cleaner which is capable of gripping a brush in the bristle-down position so that the brush bristles are immersed in the solvent contained in the artificial fingernail remover and brush cleaner. Design features enabling the accomplishment of this object include a door slidably captured between an upper housing and a lower housing, an upper housing large aperture, a lower housing aperture, at least one brush notch in the door, and a spring. Benefits associated with the accomplishment of this object include nondeformed bristles (hence lower expenditures on brushes) and less solvent evaporation during the cleaning process.

It is still another object of this invention to provide a artificial fingernail remover and brush cleaner which is manufactured of readily available materials, thereby rendering the artificial fingernail remover and brush cleaner easily affordable to the user.

BRIEF DESCRIPTION OF THE DRAWINGS

The invention, together with the other objects, features, aspects and advantages thereof will be more clearly understood from the following in conjunction with the accompanying drawings.

Seven sheets of drawings are provided. Sheet one contains FIGS. 1 and 2. Sheet two contains FIGS. 3 and 4. Sheet three contains FIGS. 5, 6 and 7. Sheet four contains FIG. 8. Sheet five contains FIGS. 9, 10, 11 and 12. Sheet six contains FIG. 13. Sheet seven contains FIG. 14.

COMPLETE DESCRIPTION OF THE PREFERRED EMBODIMENT

Figure 1:
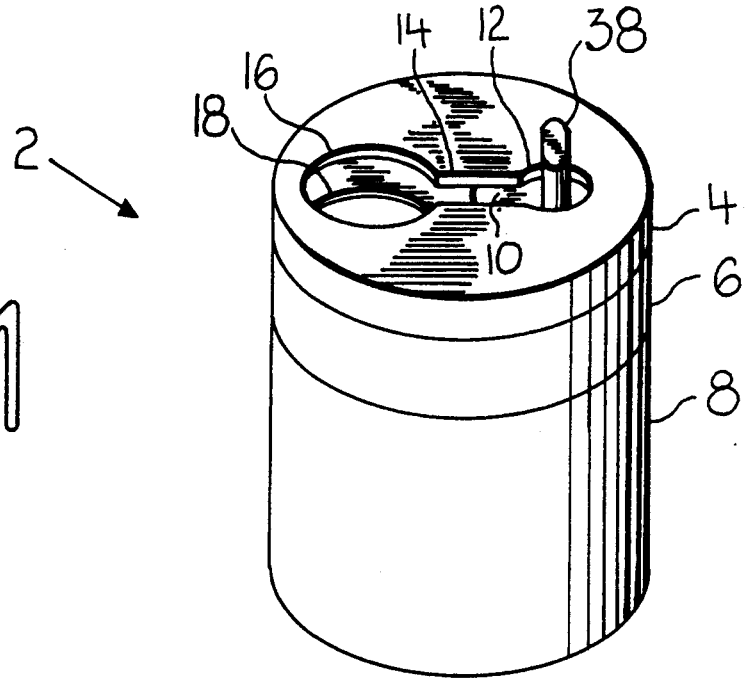
FIG. 1 is a front isometric view of an artificial fingernail remover and brush cleaner with its door in the open position.

FIG. 1 is a front isometric view of artificial fingernail remover and brush cleaner 2 with door 10 in the open position. Door 10 is slidably trapped between upper housing 4 and lower housing 6. Door 10 comprises door handle 38 which extends through upper housing small aperture 12. Upper housing small aperture 12 communicates with upper housing large aperture 16 by means of upper housing slot 14.

Upper housing 4 is attached to lower housing 6. Lower housing 6 is removably attached to container 8. The interior of container 8 communicates with the exterior through lower housing aperture 18 and upper housing large aperture 16.

Figure 2:
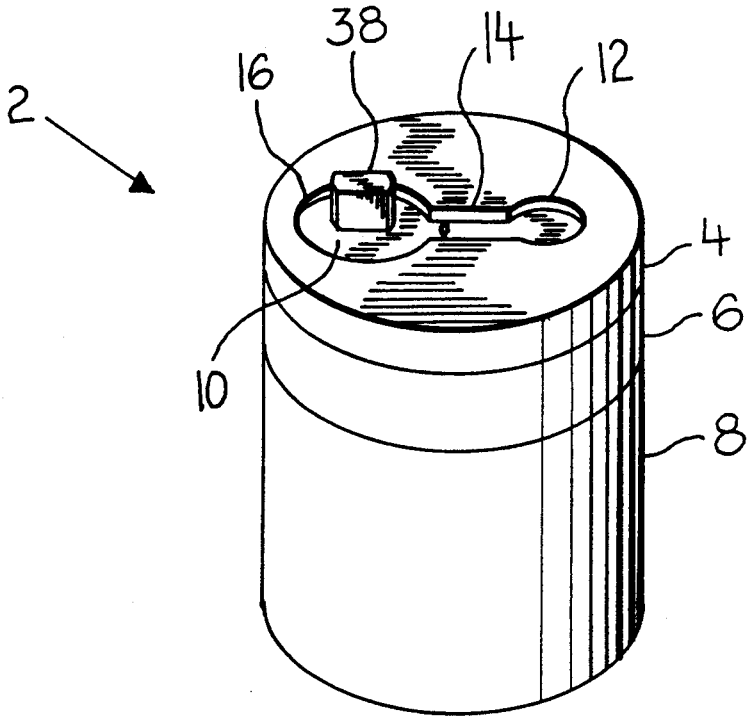
FIG. 2 is a front isometric view of an artificial fingernail remover and brush cleaner with its door in the closed position.

FIG. 2 is a front isometric view of artificial fingernail remover and brush cleaner 2 with door 10 in the closed position. Door handle 38 has translated from upper housing small aperture 12 to upper housing large aperture 16 by means of upper housing slot 14, so that door 10 prevents the interior of container 8 from communicating with the exterior, thereby preventing its contents from escaping through evaporation.

Figure 3:
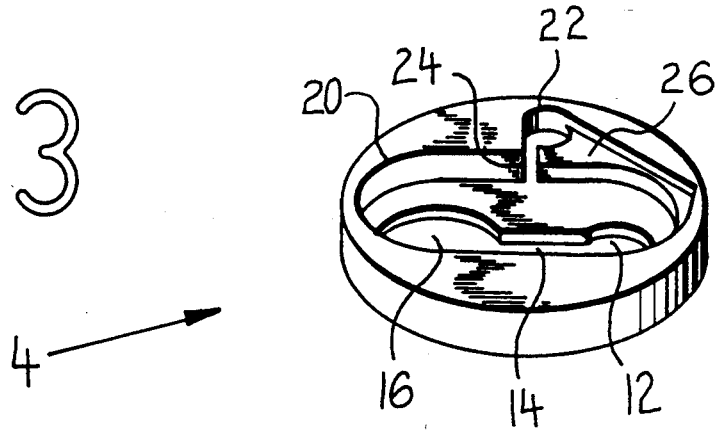
FIG. 3 is a bottom isometric view of an upper housing.

FIG. 3 is a bottom isometric view of upper housing 4. Upper housing 4 comprises door race 20 communicating with spring coil recess 22, spring long arm race 26, spring short arm recess 24, upper housing small aperture 12, upper housing large aperture 16, and upper housing slot 14.

Figure 4:
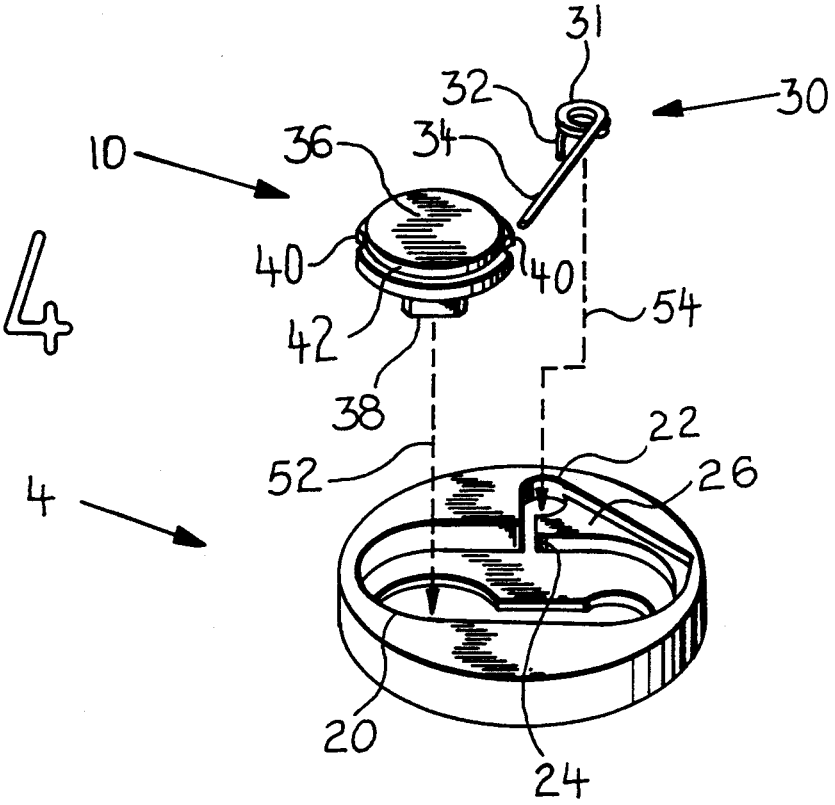
FIG. 4 is a bottom isometric view of a door, spring, and upper housing.

FIG. 4 is a bottom isometric view illustrating how door 10 and spring 30 fit into upper housing 4. Door 10 is comprised of door body 36 having brush notches 40 and spring groove 42 located on its perimeter, and door handle 38 rigidly attached to door body 36. Door body 36 is inserted into door race 20 as indicated by dashed arrow 52. Door body 36 is sized to freely reciprocate within door race 20. Spring groove 42 is sized to accommodate spring long arm 34.

Spring 30 is comprised of coil 31 terminating in spring long arm 34 at one extreme and spring short arm 32 at its other. Spring recess 22 is sized to accommodate spring coil 31 as indicated by dashed arrow 54. Spring short arm recess 24 is sized to accommodate spring short arm 32. Spring long arm race 26 is sized to allow spring long arm 34 to freely sweep within it.

Figure 5:
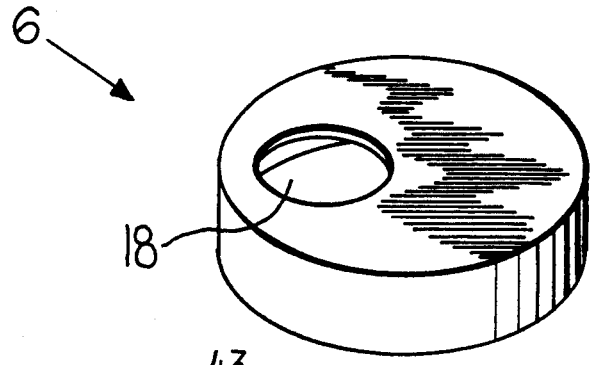
FIG. 5 is a front isometric view of a lower housing.
Figure 6:
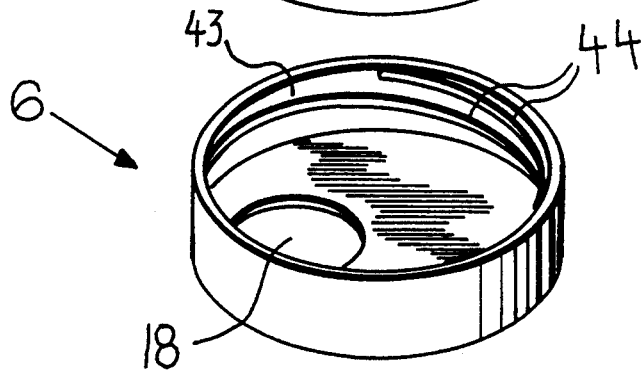
FIG. 6 is a bottom isometric view of a lower housing.

FIG. 5 is a front isometric view of lower housing 6. FIG. 6 is a bottom isometric view of lower housing 6. Lower housing 6 is comprised of lower housing bore 43 having lower housing female thread 44, and lower housing aperture 18.

Figure 8:
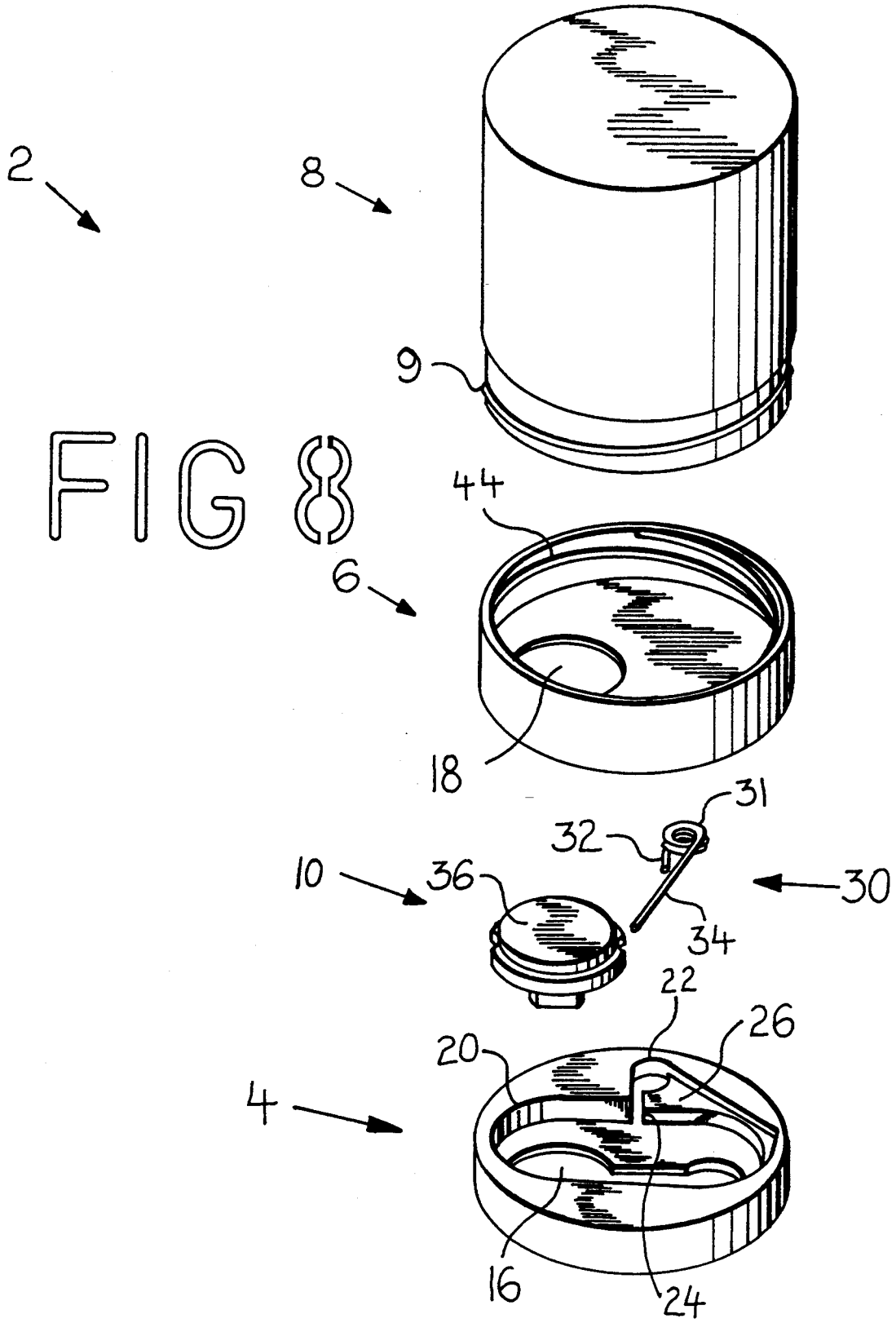
FIG. 8 is a bottom isometric exploded view of an artificial fingernail remover and brush cleaner.

FIG. 8 is a bottom isometric exploded view of artificial fingernail remover and brush cleaner 2. Container 8 comprises container male thread 9. Container male thread 9 is sized to mate with lower housing female thread 44.

Door race 20 is sized to freely accommodate door 10. Spring coil recess 22, spring short arm recess 24 and spring long arm race 26 are sized to accommodate spring 30 as shown in FIG. 4.

When lower housing 6 is attached to upper housing 4, spring short arm 32 is trapped within spring short arm recess 24, spring coil 31 is trapped within spring coil recess 22, door body 36 is free to reciprocate within door race 20 (except as prevented by door handle 38), and spring long arm 34 is free to sweep spring long arm race 26. Spring 30 is pre-loaded so as to urge door 10 to the end of door race 20 at which upper housing large aperture 16 and lower housing aperture 18 are located. When assembled, the angular orientation of upper housing large aperture 16 corresponds to the angular orientation of lower housing aperture 18, so in fact spring 30 is pre-loaded to urge door 10 into the closed position, thereby covering lower housing aperture 18.

Figure 9:
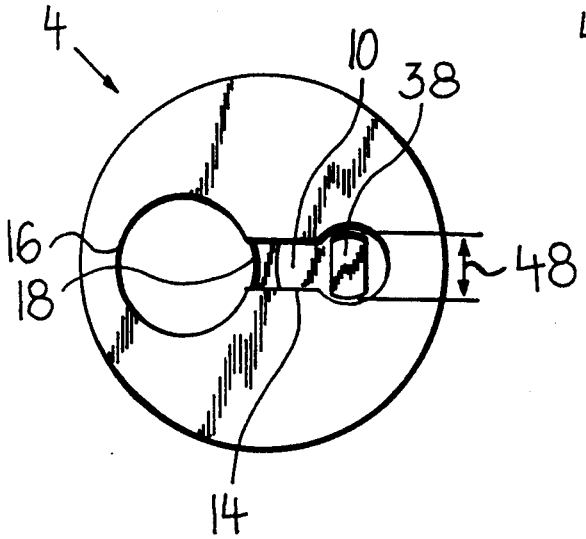
FIG. 9 is a top view of an artificial fingernail remover and brush cleaner with the door in the open position.
Figure 10:
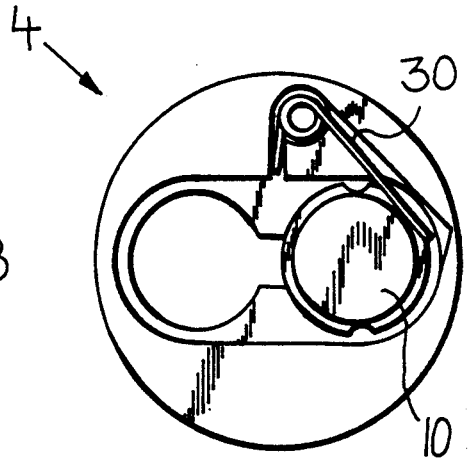
FIG. 10 is a bottom view of an upper housing with the door in the open position.

FIGS. 9 and 10 are top and bottom views respectively of door upper housing 4 with door 10 in the open position (as illustrated isometrically in FIG. 1). Spring 30 is pre-loaded so as to urge door 20 into the closed position. As depicted in FIG. 9, however, door 10 is retained in the open position because door handle width 48 is greater than the width of upper housing slot 14.

Figure 11:
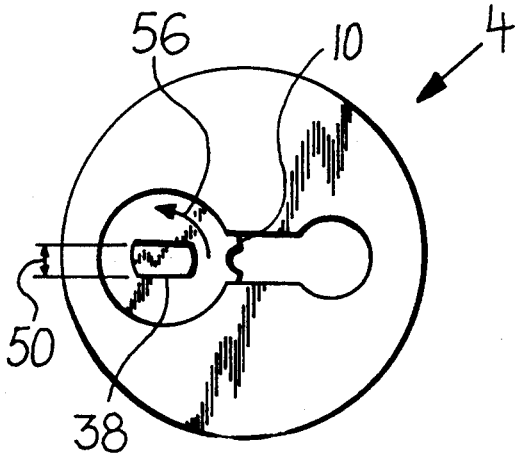
FIG. 11 is a top view of an artificial fingernail remover and brush cleaner with the door in the closed position.
Figure 12:
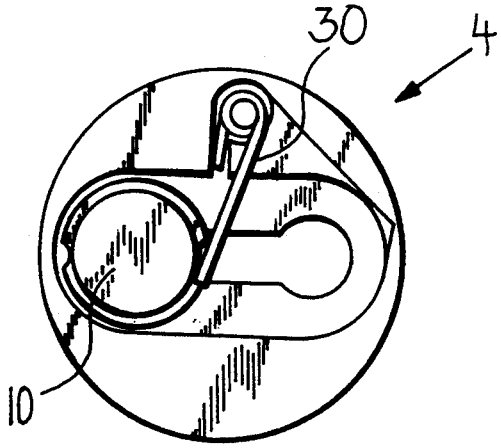
FIG. 12 is a bottom view of an upper housing with the door in the closed position.

FIGS. 11 and 12 are top and bottom views respectively of upper housing 4 with door 10 in the closed position (as illustrated isometrically in FIG. 2). Door handle 38 has been rotated approximately 90 degrees relative to its position in FIG. 9, as indicated by door handle rotation arrow 56. As shown in FIG. 11, door handle thickness 50 is less than the width of upper housing slot 14, so door 10 has been urged into the closed position by spring 30 (see FIG. 12). In this way, the angular orientation of door handle 38 relative to upper housing slot 14 either retains door 10 in the open position, or allows door 10 to slide into the closed position as urged by spring 30.

Figure 7:
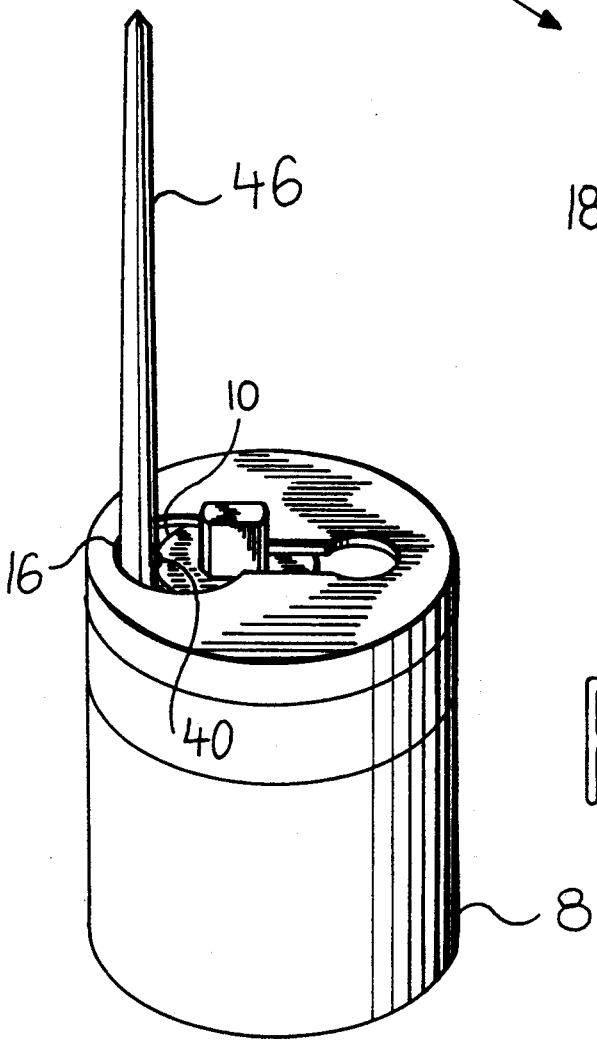
FIG. 7 is a front isometric view of a brush being cleaned in an artificial fingernail remover and brush cleaner

FIG. 7 shows a artificial fingernail remover and brush cleaner 2 being used to clean a brush 46. Brush 46 is trapped against the edge of upper housing large aperture 16 and lower housing aperture 18 by door 10 as urged by spring 30. Brush 46 fits partially within a brush notch 40, thereby helping immobilize brush 46. Brush 46 may be held as depicted in FIG. 7 so as to avoid mashing the brush bristles against the inside bottom of container 8, thereby avoiding brush disfigurement.

Figure 13:
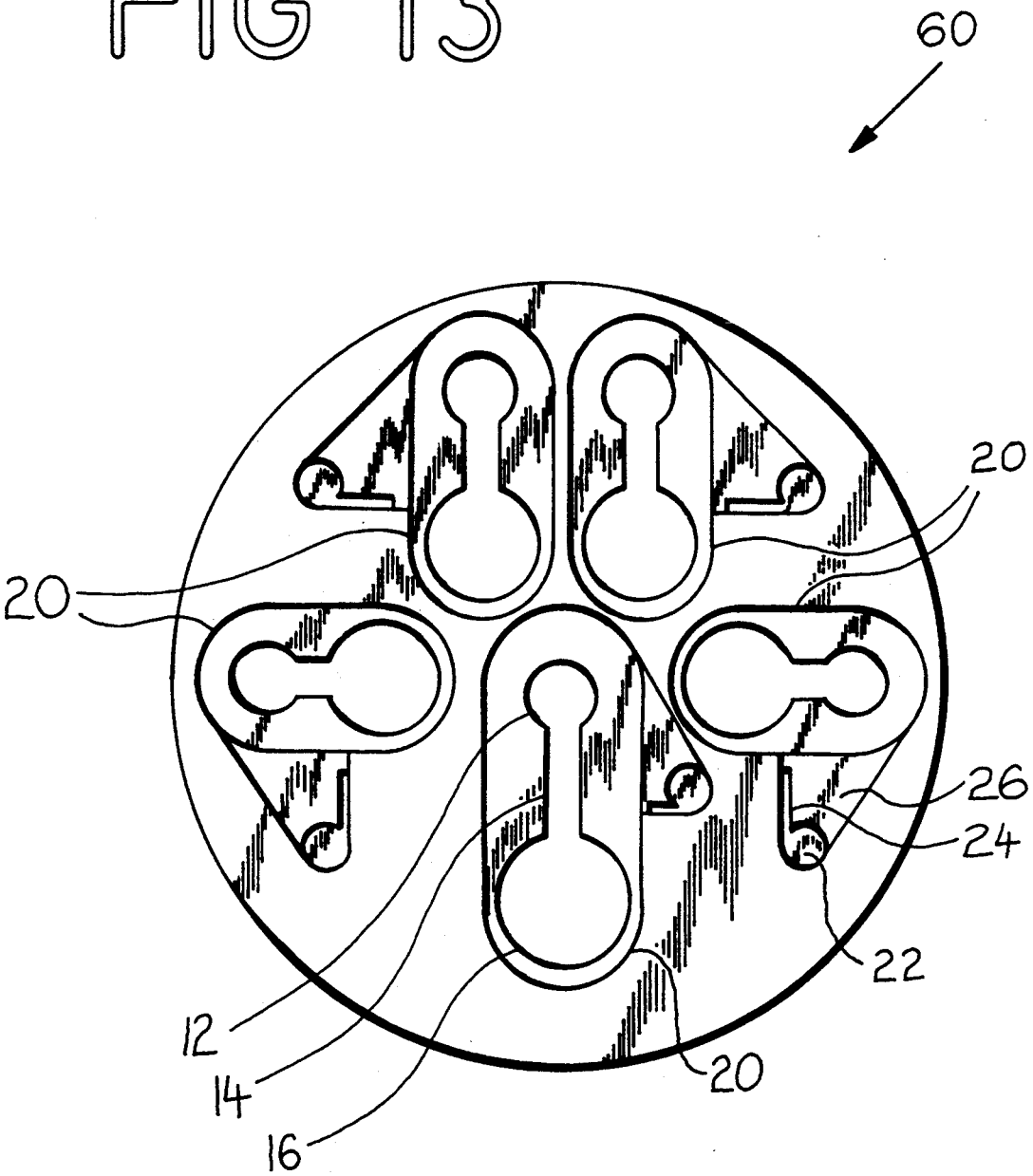
FIG. 13 is a bottom view of a multi-apertured upper housing.

FIG. 13 shows a multi-apertured upper housing 60, comprising a plurality of door races 20. Associated with each door race 20 is a communicating spring short arm recess 24, a spring coil recess 22, a spring long arm race 26, an upper housing large aperture 16, an upper housing slot 14 and an upper housing small aperture 12.

Figure 14:
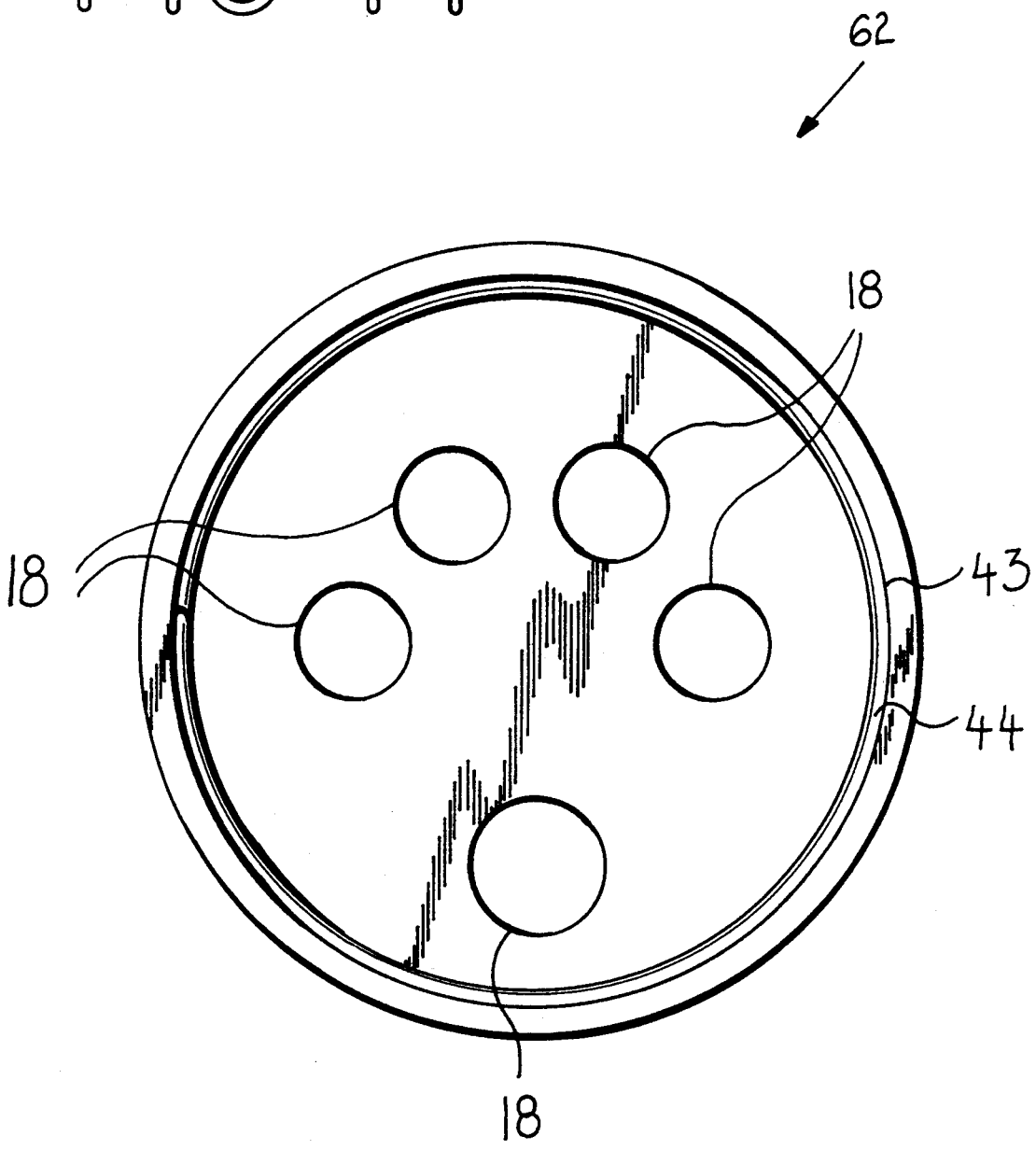
FIG. 14 is a bottom view of a multi-apertured lower housing.

FIG. 14 is a bottom view of a multi-apertured lower housing 62 comprising a plurality of lower housing apertures 18 and a lower housing bore 43 having a lower housing female thread 44.

A multi-apertured artificial fingernail remover and brush cleaner may be assembled using a multi-apertured upper housing 60 (along with the corresponding springs 30 and doors 10), a multi-apertured lower housing 62, and a container 8. The corresponding doors 10 and springs 30 are assembled into multi-apertured upper housing 60, and multi-apertured lower housing 62 is attached such that the angular orientation of lower housing apertures 18 corresponds with the angular orientation of upper housing large apertures 16. Container 8 is then removably attached to multi-apertured lower housing 62.

A multi-apertured artificial fingernail remover and brush cleaner having five apertures could be used to remove the artificial fingernails from all five fingers of a given hand simultaneously. A pair of multi-apertured artificial fingernail remover and brush cleaners could be used together to remove all ten artificial fingernails worn by an individual simultaneously, or alternately to clean fingernail polish off ten fingers simultaneously, all with a minimum of solvent evaporation.

In the preferred embodiment door 10, upper housing 4 and lower housing 6 were made of nylon, and container 8 was made of transparent glass. Spring 30 was a wire spring. Lower housing 6 was attached to upper housing 4 by means of nylon screws. Container 8 was removably attached to lower housing 6 by means of lower housing female thread 44 and container male thread 9. The cleaning fluid inside container 8 was acetone. It is envisioned the production artificial fingernail remover and brush cleaner 2 and multi-apertured artificial fingernail remover and brush cleaner will be fabricated of nylon, plastic, glass, metal or other appropriate material.

Method of Use: Artificial Fingernail Remover:

1. Remove lower housing 6 from container 8.

2. Fill container 8 approximately 75% with appropriate solvent such as acetone.
3. Re-attach container 8 to lower housing 6.
4. Slide door 10 towards upper housing small aperture 12 using door handle 38 until upper housing large aperture 16 is completely uncovered. Then rotate door handle 38 within upper housing small aperture 12 to achieve the angular orientation relative to upper housing slot 14 depicted in FIG. 1, thereby retaining door 10 in the open position.
5. Introduce the appropriate finger through upper housing large aperture 16 and lower housing aperture 18 until the artificial nail is completely immersed in the solvent contained in container 8.
6. After the appropriate time, remove the finger from artificial fingernail remover and brush cleaner 2.
7. Rotate door handle 38 so as to allow door 10 to close, thereby sealing the solvent within container 8.

Method of Use: Brush Cleaning:

1. Remove lower housing 6 from container 8.
2. Fill container 8 approximately 75% with appropriate solvent such as acetone.
3. Re-attach container 8 to lower housing 6.
4. Slide back door 10 using door handle 38 until upper housing large aperture 16 is completely uncovered. Then introduce brush 46 bristles first into the solvent through upper housing large aperture 16 and lower housing aperture 18.
5. Allow spring 30 to urge door 10 against brush 46, trapping and immobilizing brush 46 between upper housing large aperture 16 and lower housing aperture 18 on one side, and brush notch 40 on the other.
6. Remove brush 46 after the appropriate time, allowing spring 30 to completely close door 10 to avoid evaporative loss of solvent.

While a preferred embodiment of the invention has been illustrated herein, it is to be understood that changes and variations may be made by those skilled in the art without departing from the spirit and scope of the appending claims.

DRAWING ITEM INDEX artificial fingernail remover and brush cleaner
upper housing
lower housing
container
container male thread
door
upper housing small aperture
upper housing slot
upper housing large aperture
lower housing aperture
door race
spring coil recess
spring short arm recess
spring long arm race
spring
spring coil
spring short arm
spring long arm
door body
door handle
brush notch
spring groove
lower housing bore
lower housing female thread
brush
door handle width
door handle thickness
dashed arrow
dashed arrow
door handle rotation arrow
multi-apertured upper housing
multi-apertured lower housing

I claim:

1. An artificial fingernail remover and brush cleaner comprising:

an upper housing comprising an upper housing large aperture communicating with a door race;

a door comprising a door body, said door body slidably reciprocating within said door race;

a lower housing comprising a lower housing aperture, said lower housing being attached to said upper housing;

a first means to urge said door into a position covering said lower housing aperture;

a container; and a second means to removably attach said container to said lower housing.

2. The artificial fingernail remover and brush cleaner of claim 1 wherein:

said upper housing further comprises an upper housing small aperture communicating with said upper housing large aperture by means of an upper housing slot, said upper housing small aperture and said upper housing slot communicating with said door race; and said door further comprises a door handle, the width of said door handle being greater than the width of said upper housing slot, and the thickness of said door handle being less than the width of said slot, whereby said door may be retained in a position uncovering said lower housing aperture against the urging of said first means.

3. The artificial fingernail remover and brush cleaner of claim 2 wherein said first means to urge said door into a position covering said lower housing aperture comprises:

a spring short arm recess, a spring coil recess and a spring long arm race in said upper housing;

a spring groove in said door body; and a spring comprising a spring coil sized to fit within said spring coil recess, a spring short arm sized to fit within said spring short arm recess, and a spring long arm sized to sweep within said spring long arm race and fit within said spring groove.

4. The artificial fingernail remover and brush cleaner of claim 3 wherein said second means to removably attach said container to said lower housing comprises:

a lower housing bore comprising a lower housing female thread in said lower housing; and a container male thread on said container, said container male thread being sized to mate with said lower housing female thread.

5. The artificial fingernail remover and brush cleaner of claim 4 wherein the perimeter of said door body further comprises at least one brush notch.

6. A multi-apertured artificial fingernail remover and brush cleaner comprising:

a multi-apertured upper housing comprising a plurality of upper housing large apertures, each said upper housing large aperture communicating with a corresponding upper housing small aperture by means of an upper housing slot, said multi-apertured upper housing further comprising a plurality of door races, each said door race communicating with a corresponding upper housing large aperture, upper housing small aperture, and upper housing slot;

a door comprising a door body within each said door race, the doors being sized to reciprocate freely within said door races;

a multi-apertured lower housing comprising a plurality of lower housing apertures, said multi-apertured lower housing being attached to said multi-apertured upper housing and removably attached to a container; and a third means of urging each said door into a position so as to cover its associated lower housing aperture.

7. The multi-apertured artificial fingernail remover and brush cleaner of claim 6 wherein said third means of urging each said door into a position so as to cover its associated lower housing aperture comprises:

a spring short arm recess, a spring coil recess and a spring long arm race corresponding to each said door race in said upper housing;

a spring groove in each said door body; and a spring comprising: a spring coil sized to fit within each said spring coil recess, a spring short arm sized to fit within each said spring short arm recess, and a spring long arm sized to sweep within said each spring long arm race, one said spring being installed adjacent each said door race.

8. The multi-apertured artificial fingernail remover and brush cleaner of claim 7 wherein the perimeter of each said door body further comprises at least one brush notch.

* * * * *